US006112774A

United States Patent [19]

Wilson

[11] Patent Number: 6,112,774

[45] Date of Patent: Sep. 5, 2000

[54] DOUBLE LAYER PAPERMAKER'S FORMING FABRIC WITH REDUCED TWINNING.

[75] Inventor: Robert G. Wilson, Wake Forest, N.C.

[73] Assignee: Weavexx Corporation, Wake Forest, N.C.

[21] Appl. No.: 09/089,007

[22] Filed: Jun. 2, 1998

[51] Int. Cl.[7] ..... D03D 11/00; D03D 13/00; D21F 1/00

[52] U.S. Cl. ..... 139/383 A; 162/903; 442/239

[58] Field of Search ..... 442/239; 139/383 A; 162/903

[56] References Cited

U.S. PATENT DOCUMENTS

| | | | |
|---|---|---|---|
| Re. 33,195 | 4/1990 | McDonald et al. | 139/425 A |
| 4,093,512 | 6/1978 | Fleischer | 162/348 |
| 4,182,381 | 1/1980 | Gisbourne | 139/383 A |
| 4,244,543 | 1/1981 | Ericson | 248/55 |
| 4,289,173 | 9/1981 | Miller | 139/383 A |
| 4,452,284 | 6/1984 | Eckstein et al. | 139/383 A |
| 4,453,573 | 6/1984 | Thompson | 139/383 A |
| 4,501,303 | 2/1985 | Osterberg | 139/425 A |

(List continued on next page.)

FOREIGN PATENT DOCUMENTS

| | | | |
|---|---|---|---|
| 1115177 | 12/1981 | Canada . | |
| 2-277848 | 4/1989 | China . | |
| 0 048 849 A2 | of 0000 | European Pat. Off. . | |
| 0 048 962 | 9/1981 | European Pat. Off. . | |
| 0158 710 | 10/1984 | European Pat. Off. . | |
| 0185 177 | 10/1985 | European Pat. Off. . | |
| 0 224 276 | 12/1986 | European Pat. Off. . | |
| 0264 881 | 10/1987 | European Pat. Off. . | |
| 0269 070 | 11/1987 | European Pat. Off. . | |
| 0 284 575 | 2/1988 | European Pat. Off. . | |
| 0 283 181 | 3/1988 | European Pat. Off. . | |
| 0 264 881 | 4/1988 | European Pat. Off. | D21F 1/00 |
| 0 350 673 | 6/1989 | European Pat. Off. . | |
| 0 672 782 | 3/1995 | European Pat. Off. . | |
| 0 654 559 | 5/1995 | European Pat. Off. | D21F 1/00 |
| 8605115 | 4/1986 | France . | |
| 454 092 | 12/1927 | Germany . | |
| 33 29 740 | 3/1985 | Germany . | |
| 8-158285 | 12/1994 | Japan . | |
| 9-41282 | 7/1995 | Japan . | |
| 9-87990 | 9/1995 | Japan . | |
| 2245006 | 2/1991 | United Kingdom . | |
| WO 93/10304 | of 0000 | WIPO . | |
| WO 86/00099 | 1/1986 | WIPO . | |
| WO 89/09848 | 4/1989 | WIPO . | |

OTHER PUBLICATIONS

Warren, C.A., "The Importance of Yarn Properties in Wet–End Wire Construction," Seminar, The Theory of Water Removal, Dec. 12, 1979.

*Primary Examiner*—Andy Falik
*Attorney, Agent, or Firm*—Myers Bigel Sibley & Sajovec

[57] ABSTRACT

A forming fabric has machine direction yarns and cross machine direction yarns interwoven in a repeating pattern of multiple repeating units. The repeating units of the pattern comprise: paper side cross-machine direction yarns forming the paper side of the fabric; machine side cross-machine direction yarns forming the machine side of the fabric; and machine direction yarns interwoven with both the paper side cross machine direction yarns and the machine side cross machine direction yarns. The machine direction yarns comprise first and second sets of machine direction yarns arranged in an alternating pattern. Each of the machine direction yarns of the first and second sets passes above four paper side cross machine direction yarns to form paper side knuckles separated from one another by at least two paper side cross machine direction yarns. Each of the machine direction yarns of the first set passes below four machine side cross machine direction yarns to form first, second, third and fourth machine side knuckles, and each of said machine direction yarns of said second set passes below three machine side cross machine direction yarns to form fifth, sixth and seventh paper side knuckles. In this configuration, the fabric retains a desired "zig-zag" configuration on the machine side, but is less prone to twinning.

28 Claims, 6 Drawing Sheets

U.S. PATENT DOCUMENTS

| | | | |
|---|---|---|---|
| 4,515,853 | 5/1985 | Borel | 428/257 |
| 4,529,013 | 7/1985 | Miller | 139/383 A |
| 4,564,052 | 1/1986 | Borel | 139/425 A |
| 4,592,395 | 6/1986 | Borel | 139/383 A |
| 4,605,585 | 8/1986 | Johansson | 428/224 |
| 4,611,639 | 9/1986 | Bugge | 139/383 A |
| 4,633,596 | 1/1987 | Josef | 34/116 |
| 4,636,426 | 1/1987 | Fleischer | 428/224 |
| 4,642,261 | 2/1987 | Fearnhead | 428/225 |
| 4,676,278 | 6/1987 | Dutt | 139/383 A |
| 4,709,732 | 12/1987 | Kinnunen | 139/383 A |
| 4,729,412 | 3/1988 | Bugge | 139/383 A |
| 4,731,281 | 3/1988 | Fleischer et al. | 428/196 |
| 4,739,803 | 4/1988 | Borel | 139/383 A |
| 4,759,975 | 7/1988 | Sutherland et al. | 428/234 |
| 4,815,503 | 3/1989 | Borel | 139/383 A |
| 4,909,284 | 3/1990 | Kositzke | 139/383 |
| 4,934,414 | 6/1990 | Borel | 139/383 A |
| 4,941,514 | 7/1990 | Taipale | 139/383 A |
| 4,942,077 | 7/1990 | Wendt et al. | 428/152 |
| 4,945,952 | 8/1990 | Vöhringer | 139/383 A |
| 4,967,805 | 11/1990 | Chiu et al. | 139/383 A |
| 4,982,766 | 1/1991 | Taipale et al. | 139/383 |
| 4,987,929 | 1/1991 | Wilson | 139/383 A |
| 4,989,647 | 2/1991 | Marchand | 139/383 A |
| 4,989,648 | 2/1991 | Tate et al. | 139/383 A |
| 4,998,568 | 3/1991 | Vohringer | 139/383 A |
| 4,998,569 | 3/1991 | Tate | 139/383 A |
| 5,025,839 | 6/1991 | Wright | 139/383 A |
| 5,074,339 | 12/1991 | Vohringer | 139/383 A |
| 5,084,326 | 1/1992 | Vohringer | 428/194 |
| 5,092,372 | 3/1992 | Fitzka et al. | 139/383 A |
| 5,101,866 | 4/1992 | Quigley | 139/383 A |
| 5,116,478 | 5/1992 | Tate et al. | 162/358 |
| 5,152,326 | 10/1992 | Vohringer | 139/383 A |
| 5,158,118 | 10/1992 | Tate et al. | 139/383 A |
| 5,219,004 | 6/1993 | Chiu | 139/383 A |
| 5,228,482 | 7/1993 | Fleischer | 139/383 A |
| 5,358,014 | 10/1994 | Kovar | 139/383 A |
| 5,421,374 | 6/1995 | Wright | 139/383 A |
| 5,421,375 | 6/1995 | Praetzel | 139/383 A |
| 5,454,405 | 10/1995 | Hawes | 139/383 A |
| 5,456,293 | 10/1995 | Ostermayer et al. | 139/383 A |
| 5,482,567 | 1/1996 | Barreto | 139/383 A |
| 5,487,414 | 1/1996 | Kuji et al. | 139/383 A |
| 5,518,042 | 5/1996 | Wilson | 139/383 A |
| 5,520,225 | 5/1996 | Quigley et al. | 139/383 A |
| 5,542,455 | 8/1996 | Ostermayer et al. | 139/383 A |
| 5,555,917 | 9/1996 | Quigley | 139/383 A |
| 5,564,475 | 10/1996 | Wright | 139/383 A |
| 5,641,001 | 6/1997 | Wilson | 139/383 A |
| 5,694,980 | 12/1997 | Quigley | 139/383 A |
| 5,709,250 | 1/1998 | Ward et al. | 139/383 A |
| 5,746,257 | 5/1998 | Fry | 139/383 AA |
| 5,826,627 | 10/1998 | Seabrook et al. | 139/383 A |
| 5,857,498 | 1/1999 | Barreto et al. | 139/383 A |

DOUBLE LAYER PAPERMAKER'S FORMING FABRIC WITH REDUCED TWINNING.

FIELD OF THE INVENTION

This invention relates generally to woven fabrics, and relates more specifically to woven fabrics for papermaking.

BACKGROUND OF THE INVENTION

In the conventional fourdrinier papermaking process, a water slurry, or suspension, of cellulosic fibers (known as the paper "stock") is fed onto the top of the upper run of an endless belt of woven wire and/or synthetic material that travels between two or more rollers. The belt, often referred to as a "forming fabric", provides a papermaking surface on the upper surface of its upper run which operates as a filter to separate the cellulosic fibers of the paper stock from the aqueous medium, thereby forming a wet paper web. The aqueous medium drains through mesh openings of the forming fabric, known as drainage holes, by gravity alone or with assistance from one or more suction boxes located on the lower surface (i.e., the "machine side") of the upper run of the fabric.

After leaving the forming section, the paper web is transferred to a press section of the paper machine, in which it is passed through the nips of one or more pairs of pressure rollers covered with another fabric, typically referred to as a "press felt." Pressure from the rollers removes additional moisture from the web; the moisture removal is often enhanced by the presence of a "batt" layer on the press felt. The paper is then conveyed to a drier section for further moisture removal. After drying, the paper is ready for secondary processing and packaging.

Typically, papermakers' fabrics are manufactured as endless belts by one of two basic weaving techniques. In the first of these techniques, fabrics are flat woven by a flat weaving process, with their ends being joined to form an endless belt by any one of a number of well-known joining methods, such as dismantling and reweaving the ends together (commonly known as splicing), or sewing a pin-seamable flap on each end or a special foldback, then reweaving these into pin-seamable loops. In a flat woven papermakers' fabric, the warp yarns extend in the machine direction and the filling yarns extend in the cross machine direction. In the second technique, fabrics are woven directly in the form of a continuous belt with an endless weaving process. In the endless weaving process, the warp yarns extend in the cross machine direction and the filling yarns extend in the machine direction. As used herein, the terms "machine direction" (MD) and "cross machine direction" (CMD) refer, respectively, to a direction aligned with the direction of travel of the papermakers' fabric on the papermaking machine, and a direction parallel to the fabric surface and traverse to the direction of travel. Both weaving methods described hereinabove are well known in the art, and the term "endless belt" as used herein refers to belts made by either method.

Effective sheet and fiber support and an absence of wire marking are important considerations in selecting papermaking fabrics, especially in the forming section of the papermaking machine, where the wet web is initially formed. Wire marking, which is the tendency of the paper to exhibit marks where it was supported by the yarns or wires of a papermaking fabric, is the result of individual cellulosic fibers being oriented within the paper web such that their ends reside within gaps between the individual threads or yarns of the forming fabric. Wire marking can be particularly problematic in the formation of fine paper grades, as it can affect a host of paper properties, such as sheet mark, porosity, see-through, and pin holing. This problem is generally addressed by providing a water permeable fabric structure with a substantially coplanar fine mesh that allows paper fibers to bridge adjacent yarns of the fabric rather than penetrating the gaps between yarns. As used herein, "coplanar" means that the upper extremities of the yarns defining the paper-forming surface are at substantially the same elevation, such that a substantially "planar" surface is present. Accordingly, fine paper grades intended for use in carbonizing, cigarettes, electrical condensers, quality printing, and like grades of fine paper, have typically heretofore been formed on very fine woven or wire mesh forming fabrics.

Unfortunately, such finely woven forming fabrics often are delicate and may lack dimensional stability in either or both of the machine and cross machine directions (particularly during operation), leading to a short service life for the fabric. In addition, a fine weave may adversely affect drainage properties of the fabric, thereby rendering it less suitable for use as a forming fabric.

To combat these problems associated with fine weaves, multi-layer forming fabrics have been developed with fine mesh yarns on the paper forming surface to facilitate paper formation and larger yarns on the machine contact side to provide strength and longevity. As examples, U.S. Pat. No. 4,709,732 discloses a dual layer forming fabric for use in a papermaking process, and U.S. Pat. No. 4,605,585 teaches a two-ply forming fabric with a twill or satin weave pattern.

Although double-layer fabrics have proven to be effective forming fabrics for many applications, they can be expensive to manufacture. Also, different paper varieties are generally produced on different types of fabrics. For example, a high grade paper, such as that used in magazines and printers, is typically produced on a considerably different fabric than tissue paper, which has significantly more lenient surface standards. Accordingly, fabric designers are constantly searching for new designs that provide an appropriate balance of performance characteristics and cost.

One example of a double-layer fabric which is suitable for forming tissue paper is disclosed in U.S. Pat. No. 5,025,839 to Wright. This fabric employs MD yarns that are interwoven with the machine side CMD yarns in an "under 1/over 1/under 1/over 5" pattern, and with the CMD yarns of the paper side of the fabric in an "over 1/under 2/over 1/ under 12" repeating pattern, with the MD yarns interlacing with the machine side CMD yarns in the "under 12" sections. The result of this specific pattern is that the MD yarns take a "zig-zag" configuration on the machine side of the fabric that reportedly improves drainage.

Unfortunately, this fabric has proven to be prone to "twinning" of its paper side CMD yarns in the "under 2" positions of the pattern (the positions between the locations where the MD yarns pass over the paper side CMD yarns to form paper side "knuckles"). Twinning is the tendency for adjacent paper side CMD yarns to reside near one another rather than being spaced apart a uniform distance. This is caused by tension in the machine direction yarns due to the "under 1/over 1/under 1" portion of the machine side pattern (a tension-inducing configuration). This tension forces the "under 2" paper side CMD yarns together in a "twinned" configuration. Twinning can result in uneven drainage through the paper side layer due to the disparity in drainage hole size, the result of which can be inconsistent paper surface qualities.

SUMMARY OF THE INVENTION

In view of the foregoing, it is an object of the present invention to provide a forming fabric having a sound balance of strength, drainage, and surface characteristics.

It is also an object of the present invention to provide a forming fabric that reduces twinning of paper side CMD yarns.

It is another object of the present invention to provide a forming fabric suitable for the formation of tissue paper.

These and other objections are satisfied by the present invention, which relates to a papermakers' forming fabric that is particularly suitable for forming tissue paper. The forming fabric has a top machine side and an opposing bottom paper side and comprises machine direction yarns and cross machine direction yarns interwoven in a repeating pattern of multiple repeating units. The repeating units of the pattern comprise: a first preselected number of paper side cross-machine direction yarns forming the paper side of the fabric; a second preselected number of machine side cross-machine direction yarns forming the machine side of the fabric, wherein the first preselected number is at least twice as large as the second preselected number, and wherein each of the machine side cross machine direction yarns is positioned below a paper side cross machine direction yarn; and a third preselected number of machine direction yarns, each of which is interwoven with both the paper side cross machine direction yarns and the machine side cross machine direction yarns. The machine direction yarns comprise first and second sets of machine direction yarns arranged in an alternating pattern, with each machine direction yarn of the first set being positioned between two machine direction yarns of the second set, and each machine direction yarn of the second set being positioned between two machine direction yarns of the first set. Within the repeating unit, each of the machine direction yarns of the first set passes above four paper side cross machine direction yarns to form first, second, third and fourth paper side knuckles. The first and second paper side knuckles are separated from one another by at least two paper side cross machine direction yarns, and the third and fourth paper side knuckles are separated by at least two paper side cross machine direction yarns. Each of the machine direction yarns of the second set passes above four paper side cross machine direction yarns to form fifth, sixth, seventh and eighth paper side knuckles. The fifth and sixth paper side knuckles are separated from one another by at least two paper side cross machine direction yarns, and the seventh and eighth paper side knuckles are separated by at least two paper side cross machine direction yarns. Each of the machine direction yarns of the first set passes below four machine side cross machine direction yarns to form first, second, third and fourth machine side knuckles, and each of said machine direction yarns of the second set passes below three machine side cross machine direction yarns to form fifth, sixth and seventh paper side knuckles. Each of the machine side first, second, third and fourth knuckles formed by one machine direction yarn of the first set under a respective machine side cross machine direction yarn has a corresponding one of the first, second, third and fourth knuckles on an adjacent machine direction yarn of the first set formed under the same machine side cross machine direction yarn. Also, each of two of the fifth, sixth and seventh machine side knuckles formed by one machine direction yarn of the second set under a respective machine side cross machine direction yarn has a corresponding one of the fifth, sixth and seventh knuckles on an adjacent machine direction yarn of the second set formed under the same machine side cross direction yarn, but the other one of the fifth, sixth and seventh knuckles of the one machine direction yarn of the second set has no corresponding fifth, sixth or seventh knuckle on an adjacent machine direction yarn of the second set formed under the same machine side cross machine direction yarn. In this configuration, the fabric retains the desired "zig-zag" configuration on the machine side, but is less prone to twinning.

In a preferred embodiment, the repeating unit of the fabric includes 16 machine side CDM yarns, 32 paper side CDM yarns, and 16 machine direction yarns. The machine direction yarns are interwoven such that the first and second paper side knuckles are separated by two paper side CMD yarns. Also, the first and third machine side knuckles are separated by two MD yarns, as are the second and fourth machine side knuckles. This configuration provides a machine side configuration with superior wear resistance and a paper side configuration that is particularly suitable for tissue paper forming.

In a second embodiment, the present invention is directed to a papermaker's fabric that has a top machine side and an opposing bottom paper side and comprises machine direction yarns and cross machine direction yarns interwoven in a repeating pattern of multiple repeating units. A repeating unit of the fabric of this embodiment comprises: a first preselected number of paper side cross-machine direction yarns forming the paper side of the fabric; a second preselected number of machine side cross-machine direction yarns forming the machine side of the fabric, wherein the first preselected number is at least twice as large as the second preselected number, and wherein each of the machine side cross machine direction yarns is positioned below a paper side cross machine direction yarn; and a third preselected number of machine direction yarns, each of which is interwoven with both the paper side cross machine direction yarns and the machine side cross machine direction yarns. Within the repeating unit, each of the machine direction yarns passes above two paper side cross machine direction yarns to form first and second paper side knuckles which are separated from one another by at least two paper side cross machine direction yarns. Each of the machine direction yarns also passes below two machine side cross machine direction yarns to form first and second machine side knuckles. Each of the machine side knuckles formed by a first machine direction yarn under a respective machine side cross machine direction yarn has a corresponding one of the first and second knuckles on a second machine direction yarn formed under the same machine side cross machine direction yarn, wherein the first and second machine direction yarns are separated by a third machine direction yarn. The first and second paper side knuckles of the third machine direction yarn are formed as the third machine direction yarn passes over paper side cross machine direction yarns other than the paper side cross machine direction yarn positioned directly above the machine side cross machine direction yarn under which the first machine side knuckle of the first machine direction yarn is formed. In this configuration, the tension that can be induced in the machine direction yarns by the machine side knuckle configuration can be reduced.

DETAILED DESCRIPTION OF THE INVENTION

Figure 1:
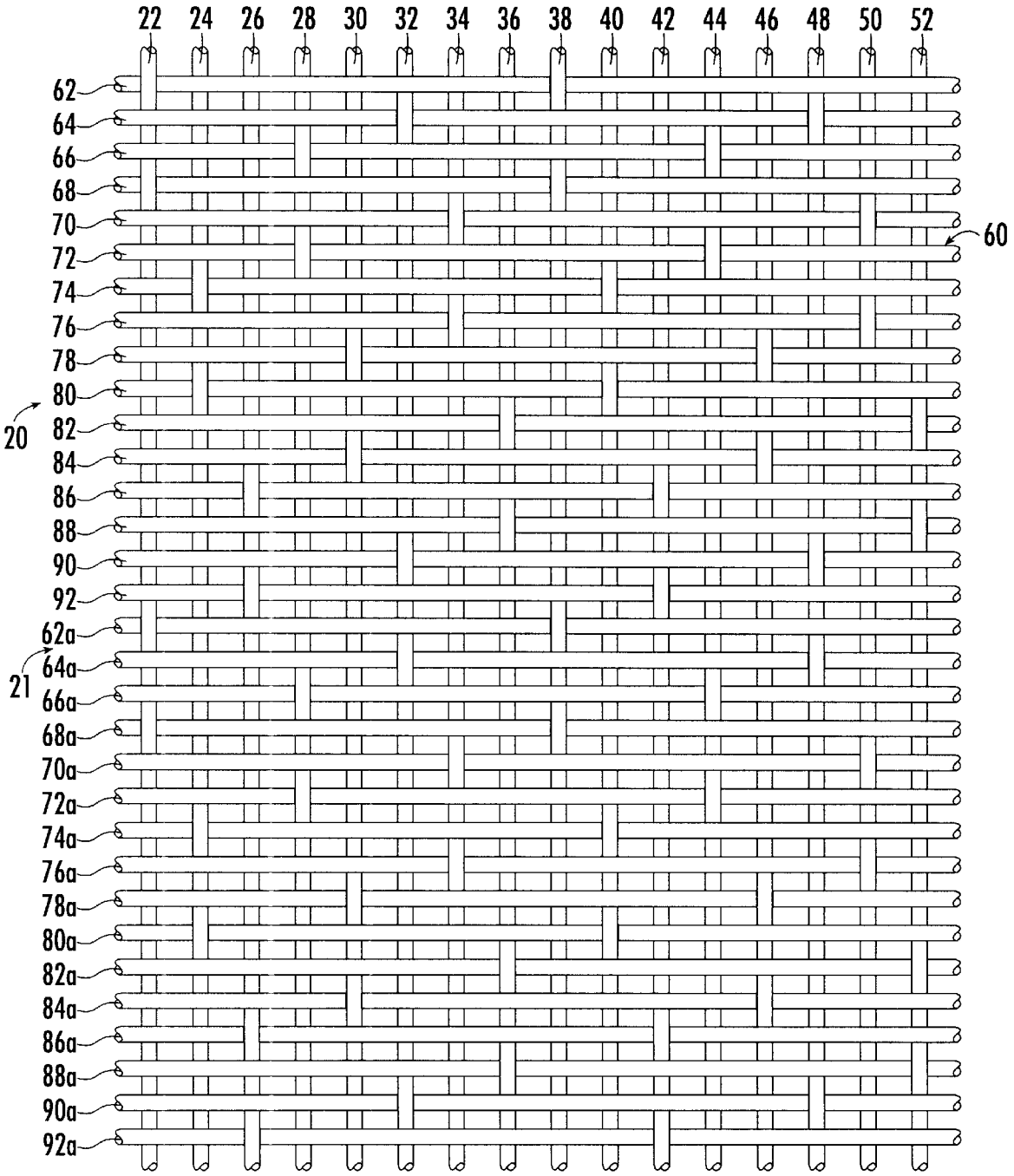
FIG. 1 is a schematic plan view of the paper side of the forming fabric of the present invention.

The present invention will now be described more particularly hereinafter with reference to the accompanying drawings, in which present embodiments of the present invention are shown. The invention may, however, be embodied in many different forms and is not limited to the embodiment set forth herein; rather, this embodiment is provided so that the disclosure will fully convey the scope of the invention to those skilled in this art.

Referring now to the drawings, a double layer fabric 20 is illustrated in FIGS. 1 through 18. The double layer fabric 20 includes a number of repeating units (one of which is designated at 21 in FIG. 1) formed of machine direction (MD) yarns which interlace with paper side cross-machine direction (CMD) yarns and machine side CMD yarns. The sixteen MD yarns of the illustrated repeating unit are designated at 22, 24, 26, 28, 30, 32, 34, 36, 38, 40, 42, 44, 46, 48, 50, and 52. These can be divided into two sets of alternating MD yarns, with the first set comprising MD yarns 22, 26, 30, 34, 38, 42, 46 and 50, and the second set comprising MD yarns 24, 28, 32, 36, 40, 44, 48 and 52.

Figure 2:
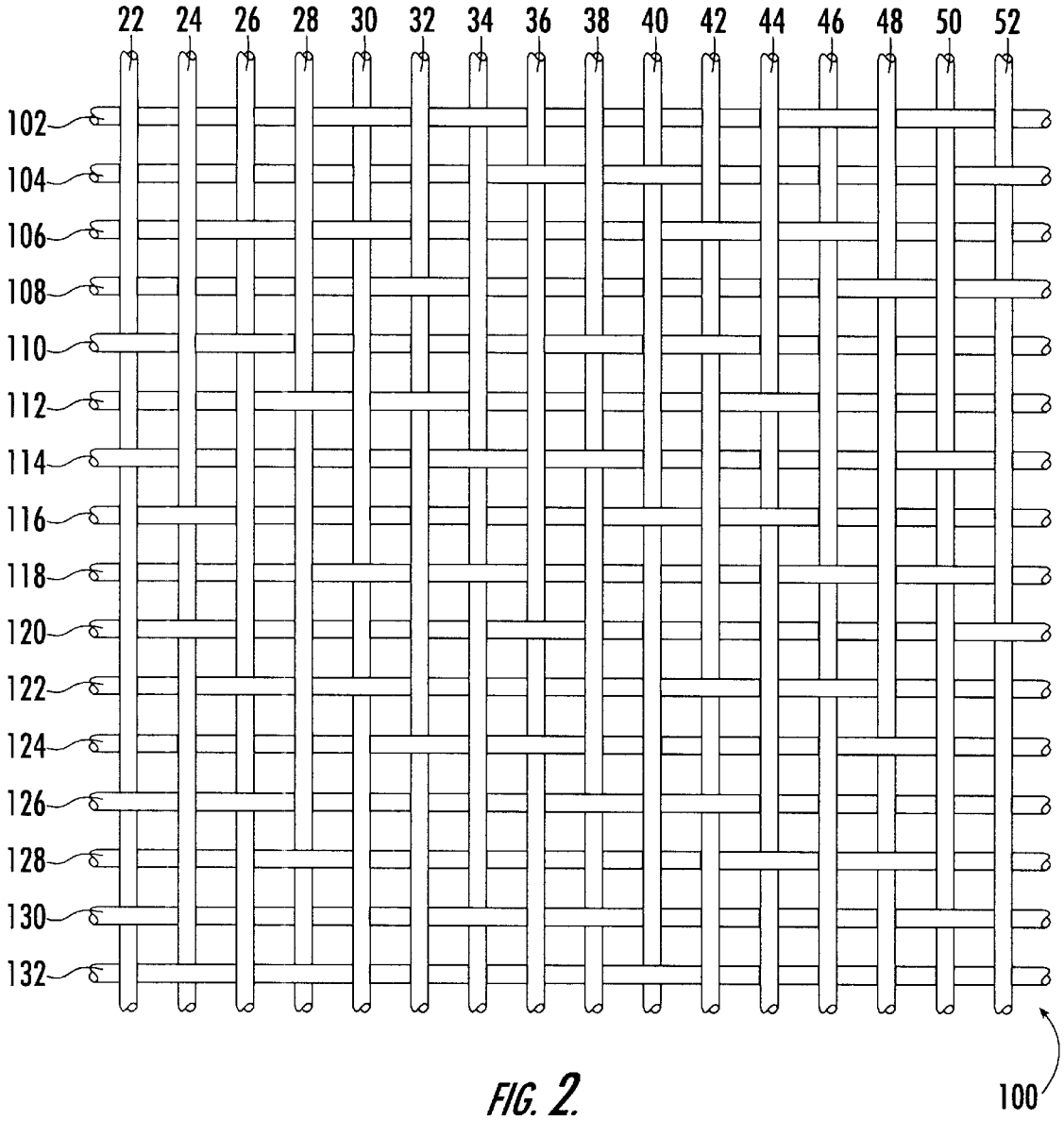
FIG. 2 is a schematic cutaway plan view of the machine side of the forming fabric of FIG. 1; this view does not illustrate the "zig-zag" effect of the MD yarns on the machine side of the fabric in order to clarify the interweaving pattern of the fabric.

These MD yarns are interwoven with two different sets of CMD yarns: those forming the paper side layer 60 of the fabric 20 (see FIG. 1); and those forming the machine side layer 100 (see FIG. 2). For each repeating unit 21, a total of thirty-two paper side CMD yarns are included. These are designated sequentially in FIGS. 1 and 3–18 at 62, 64, 66, 68, 70, 72, 74, 76, 78, 80, 82, 84, 86, 88, 90,92, 62*a*, 64*a*, 66*a*, 68*a*, 70*a*, 72*a*, 74*a*, 76*a*, 78*a*, 80*a*, 82*a*, 84*a*, 86*a*, 88*a*, 90*a*, and 92*a*. The machine side CMD layer 100 comprises sixteen machine side CMD yarns; these are sequentially designated in FIGS. 2–18 at 102, 104, 106, 108, 110, 112, 114, 116, 118, 120, 122, 124, 126, 128, 130 and 132.

Figure 3:
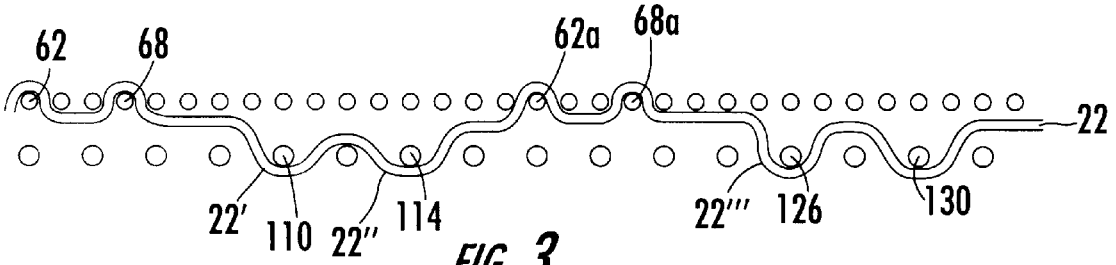
FIGS. 3 through 18 are section views taken along successive machine direction yarns illustrating the interlacing pattern of the machine direction yarns relative to the paper side and machine side cross-machine direction yarns.

The interweaving pattern of the individual MD yarns is best understood by reference to FIGS. 3 through 18, each of which illustrates the interweaving of one MD yarn through the paper side and machine side CMD yarns. For example, FIG. 3 shows the MD yarn 22 as it passes over the paper side CMD yarn 62, under the paper side CMD yarns 64 and 66, over the paper side CMD yarn 68, and under the paper side CMD yarns 70 through 92. For the purposes of explanation herein, "above," "up," and the like refer to the direction the paper side of the fabric 20 faces (toward the top of the page in FIGS. 3–18), and "below," "beneath," and the like refer to the direction the machine side of the fabric faces. This interweaving pattern for the MD yarn 22 is repeated for paper side CMD yarns 62*a* through 92*a*. Thus, the MD yarn 22 has an "over 1/under 2/over 1/under 12" repeat pattern as it interlaces with the paper side CMD yarns. For the repeat unit 21 illustrated in FIG. 1, the over 1/under 2/over 1/under 12 pattern is repeated twice.

As can be seen in FIGS. 1 and 4 through 18, each of the remaining MD yarns 24 through 52 follows the same weave pattern relative to the paper side CMD yarns. Thus, each MD yarn follows an over 1/under 12/over 1/under 12 pattern relative to the paper side CMD yarns.

As seen in FIG. 1, adjacent MD yarns are interlaced relative to the paper side CMD yarns on a six paper side CMD yarn offset; i.e., the knuckles formed by the MD yarns on the paper surface by one MD yarn are separated from the corresponding knuckles on adjacent MD yarns by six paper side CMD yarns. For example, the MD yarn 22 forms a first paper side knuckle as it passes over the paper side CMD yarn 62 and another paper side knuckle as it passes over the paper side CMD yarn 68. The next adjacent MD yarn 24 forms paper side knuckles as it passes over the paper side CMD yarn 74 and the paper side CMD yarn 80, each of which are six CMD yarns from their corresponding knuckles on the MD yarn 22. This six paper side CMD yarn offset is carried through the repeat unit of the fabric 20.

Referring back to FIG. 3, as the MD yarn 22 passes between paper side CMD yarns 62 through 92*a*, it also interweaves with the machine side CMD yarns. More specifically, the MD yarn 22 passes above machine side CMD yarns 102, 104, 106 and 108, below machine side CMD yarn 110, above machine side CMD yarn 112, below machine side CMD yarn 114, above machine side CMD yarns 116 through 124, below machine side CMD yarn 126, above machine side CMD yarn 128, below machine side CMD yarn 130, and above machine side CMD yarn 132. Thus, the MD yarn 22 has an "over 5/under 1/over 1/under 1" interweaving pattern relative to the machine side CMD yarns that is repeated twice within the repeat unit 121. As can be seen in FIGS. 1, 5, 7, 9, 11, 13, 15, and 17, the MD yarns of the first set of alternate MD yarns 26, 30, 34, 38, 42, 46 and 50 follow the same pattern as MD yarn 22 relative to the machine side CMD yarns.

Figure 4:
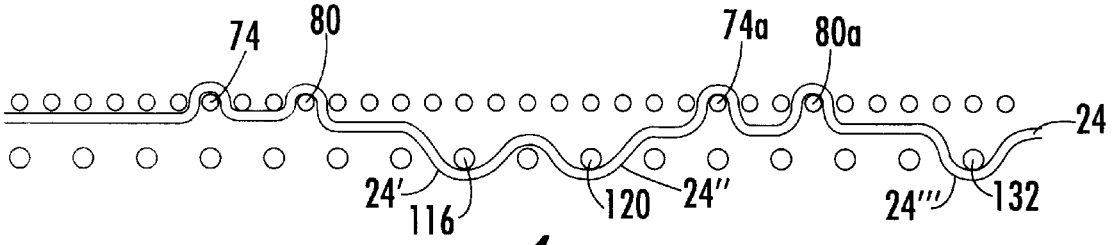

Referring now to FIG. 4, it can be seen that MD yarn 24 passes above machine side CMD yarns 102 through 114, below machine side CMD yarn 116, above machine side CMD yarn 118, below machine side CMD yarn 120, above machine side CMD yarns 122 through 130, and below machine side CMD yarn 132. Thus, relative to the machine side CMD yarns, MD yarn 24 has an "over 7/under 1/over 1/under 1/over 5/under 1" pattern. Notably, this pattern differs from that of adjacent MD yarns 22 and 26. As can be seen in FIGS. 1, 6, 8, 10, 12, 14, 16 and 18, the "over 7/under 1/over 1/under 1/over 5/under 1" followed by MD yarn 24 is also followed by the second set of alternate MD yarns 28, 32, 36, 40, 44, 48 and 52. For these MD yarns, three machine side knuckles are formed in the repeat pattern rather than the four machine side knuckles formed in the repeat pattern by the first set of alternate MD yarns 22, 26, 30, 34, 38, 42, 46 and 50.

As can be seen in FIG. 2, the machine side knuckles of each MD yarn formed by the "under 1/over 1/under 1" portion common to both patterns of MD yarns are offset from their corresponding knuckles on adjacent MD yarns by a three machine side CMD yarn offset. As an example, the MD yarn 22 forms a machine side knuckle 22' as it passes under the machine side CMD yarn 110 and another machine side knuckle 22" as it passes under the machine side CMD yarn 114 (See FIG. 3). The next adjacent MD yarn, which is MD yarn 24, forms a machine side knuckle 24' as it passes under the machine side CMD yarn 116 and another machine side knuckle 24'" as it passes above the machine side CMD yarn 120 (see FIG. 4). Thus, these machine side knuckles of adjacent MD yarns are offset from one another by three machine side CMD yarns.

Figure 5:
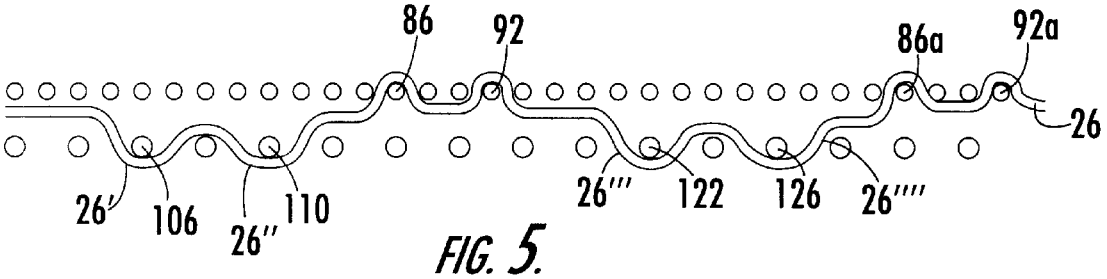
Figure 6:
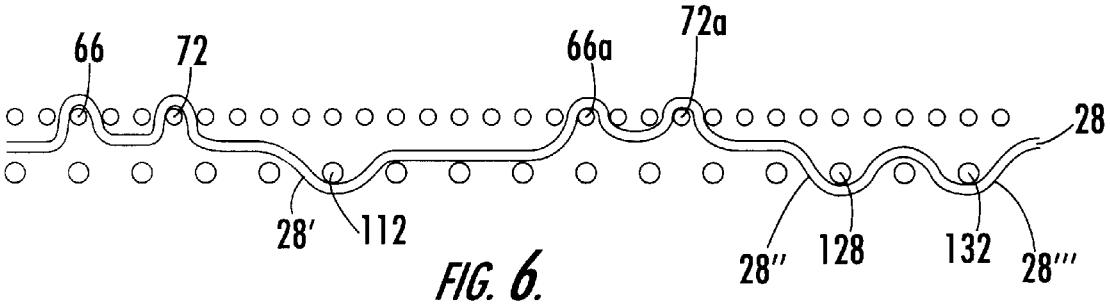
Figure 7:
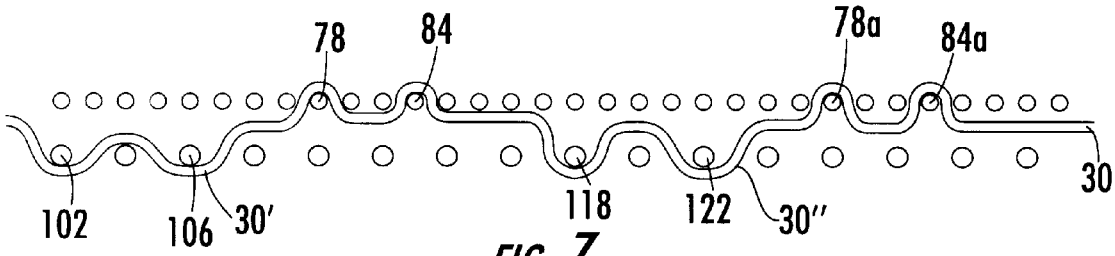
Figure 8:
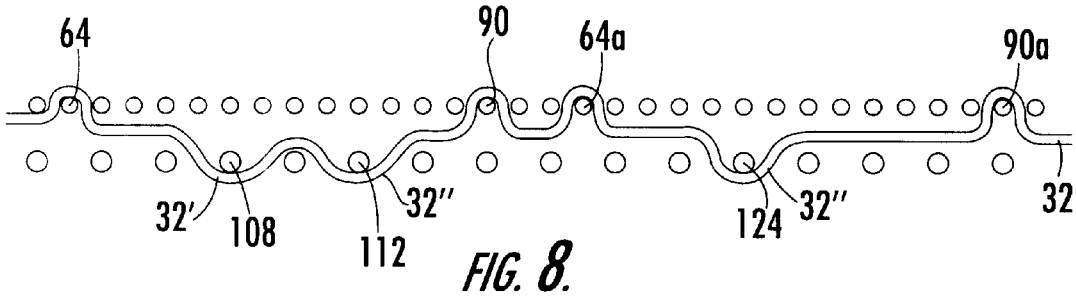
Figure 9:
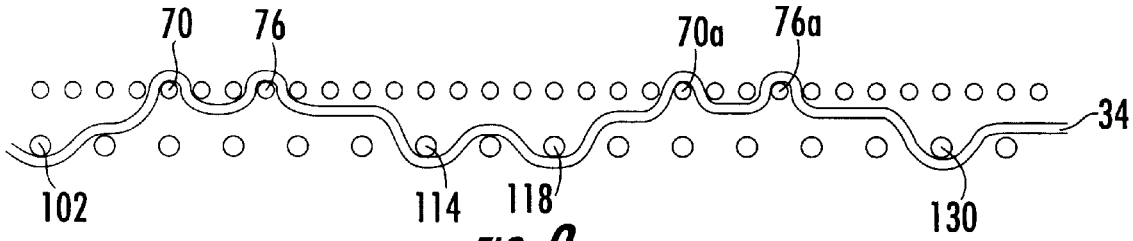
Figure 10:
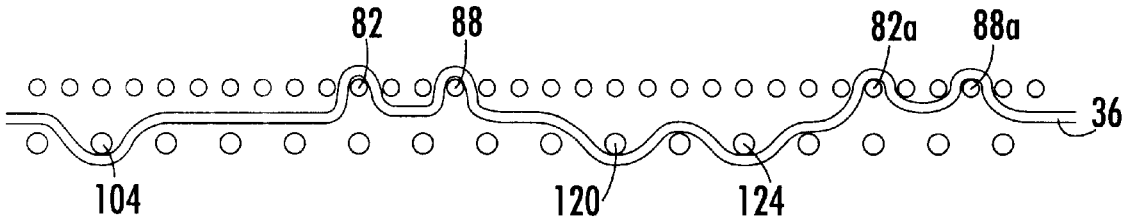
Figure 11:
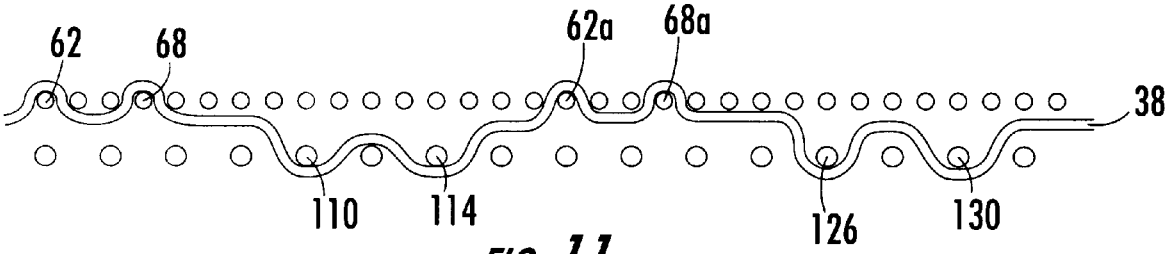
Figure 12:
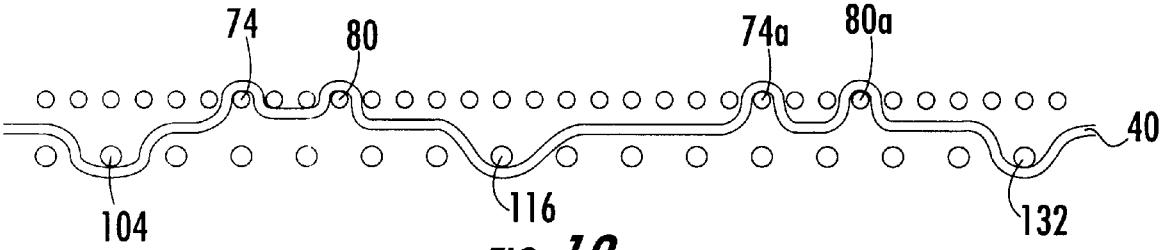
Figure 13:
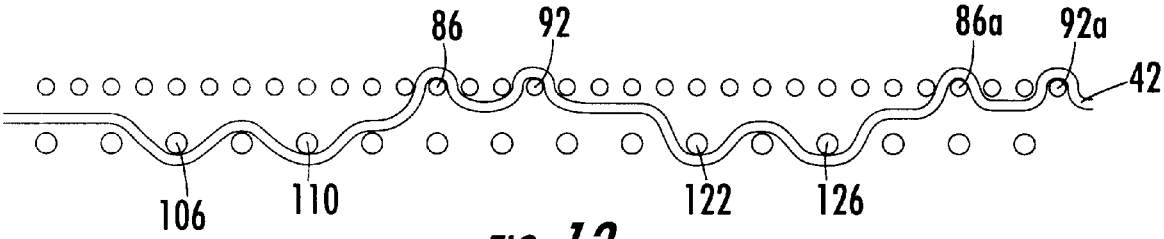
Figure 14:
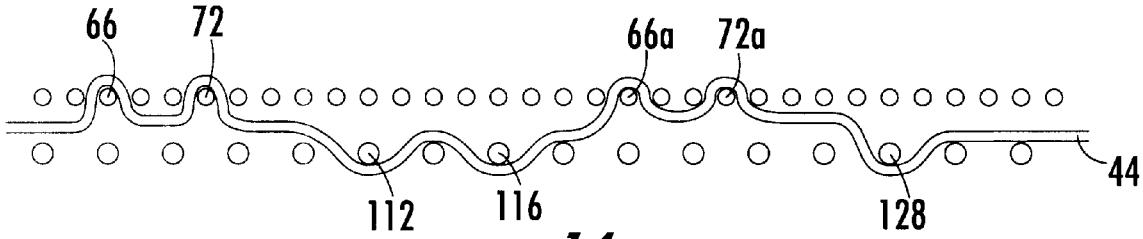
Figure 15:
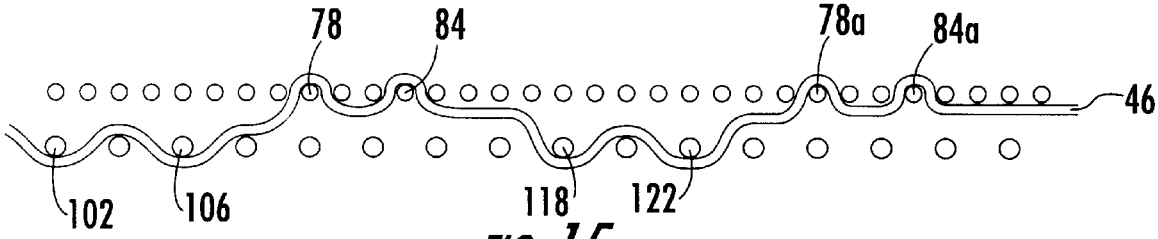
Figure 16:
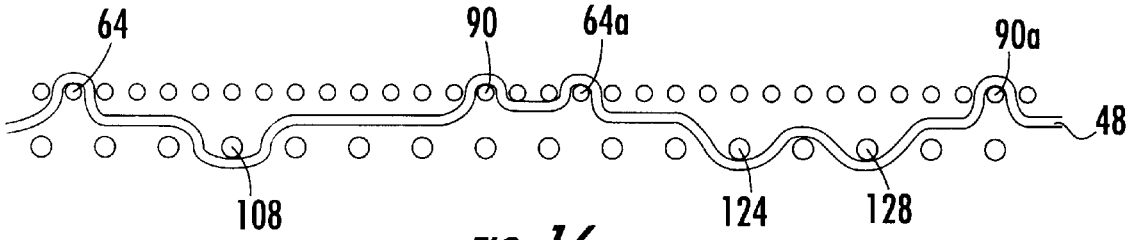
Figure 17:
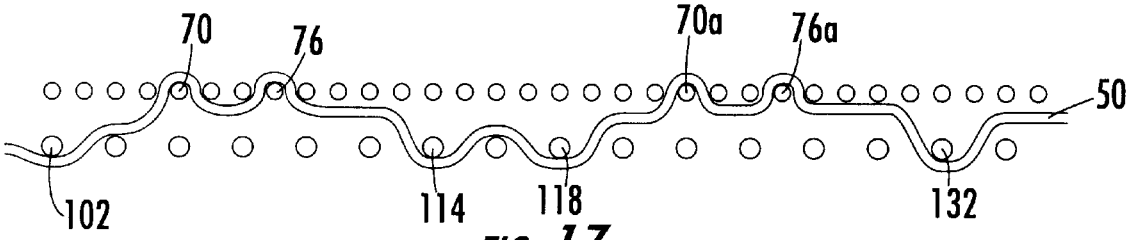
Figure 18:
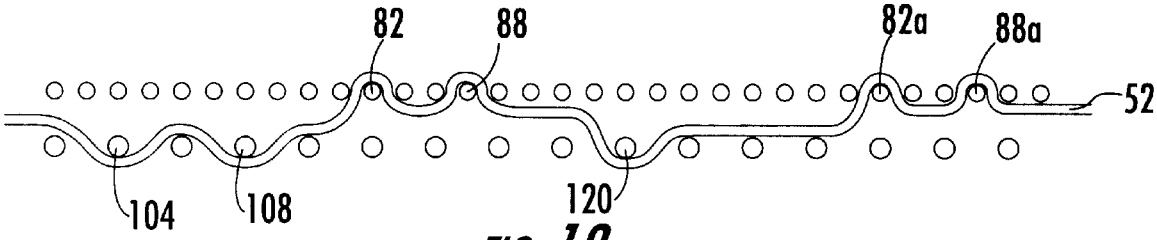

Referring again to FIG. 2, it can be seen that, for the first set of alternate MD yarns 22, 26, 30, 34, 38, 42, 46 and 50, this weave pattern causes machine side knuckles to be formed under the same machine side CMD yarn by MD yarns that are separated by one MD yarn of the second set of alternate MD yarns. For example, the MD yarn 26 forms machine side knuckles 26', 26", 26'", 26"" as it passes below the machine side CMD yarn 106, 110, 122 and 126 (FIG. 5). Moving over one MD yarn to the MD yarn 30, it can be seen that the MD yarn 30 also forms machine side knuckles (designated at 30', 30") as it passes under the machine side CMD yarns 106 and 122 (FIG. 7). Moving over one MD yarn in the opposite direction to the MD yarn 22, it can be seen that MD yarn 22 forms machine side knuckles 22', 22'" as it passes under machine side CMD yarns 110 and 126. Thus, for the first set of alternate yarns 22, 26, 30, 34, 38, 42, 46 and 50, each machine side knuckle has a corresponding knuckle formed under the same machine side CMD yarn on an adjacent MD yarn of the first set of alternate yarns.

In contrast, the second set of alternate MD yarns 24, 28, 32, 36, 40, 44, 48 and 52 are not arranged so that every machine side knuckle has a corresponding machine side knuckle under the same machine side CMD yarn on an adjacent MD yarn of the second set. As an example, MD yarn 28 has machine side knuckles 28', 28", 28'" under machine side CMD yarns 112, 128 and 132. Moving over one MD yarn to MD yarn 32, the adjacent MD yarn of the second set, MD yarn 32 has machine side knuckles 32', 32", 32'" under machine side CMD yarns 108, 112 and 124. Moving from MD yarn 28 over one MD yarn in the opposite direction to MD yarn 24, the adjacent MD yarn of the second set in the opposite direction, MD yarn 24 has machine side knuckles 24', 24", 24'" under machine side CMD yarns 116, 120 and 132. Thus, although for MD yarn 28 there are corresponding machine side knuckles under machine side CMD yarns 132 and 112 on adjacent MD yarns of the second set of alternate MD yarns, there is no corresponding machine side knuckle on either of these adjacent MD yarns of the second set under machine side CMD yarn 128. Each of the other MD yarns of the second set of alternate MD yarns 24, 28, 32, 36, 40, 44, 48 and 52 similarly has one machine side knuckle that lacks a corresponding machine side knuckle under the same machine side CMD yarn on either of the adjacent MD yarns of the second set.

The arrangement of the knuckles is a desirable configuration for the machine side of a fabric, as separation of machine side knuckles formed on the same machine side CMD yarn by one MD yarn has been shown to provide suitable wear characteristics. The effect of having two adjacent machine direction yarns located between machine direction yarns which form knuckles on the same machine side CMD yarn is that the "zig-zag" effect produced by other double-layer fabrics, such as the fabric disclosed in U.S. Pat. No. 5,025,839 to Wright, is desirably preserved (this effect, which is illustrated in exaggerated detail in the drawings of U.S. Pat. No. 5,025,839, the disclosure of which is incorporated by reference herein in its entirety, is not illustrated in FIG. 2 for the purpose of clarity of the weave pattern). The effect can be tempered somewhat to a less pronounced zig-zag by the absence of corresponding knuckles for one of the knuckles on each MD yarn of the second set of alternate yarns.

In addition, it should be noted that there is no paper side knuckle formed over a paper side CMD yarn between the aforementioned machine side knuckles that are formed under the same paper side CMD yarn on adjacent MD yarns of either the first or second sets of alternating MD yarns. For example, MD yarns 22 and 26 form machine side knuckles under machine side CMD yarns 110 and 126; however, MD yarn 24 fails to form a paper side knuckle over either of the paper side CMD yarns 78, 78*a* that are positioned above these CMD yarns. Instead, MD yarn 24 forms paper side knuckles over paper side CMD yarns 80, 80*a* that are offset by one paper side CMD yarn from the paper side CMD yarns 78, 78*a*. This configuration can be advantageous in that it can reduce the tension induced by the "under 1/over 1/under 1" portion of the machine side pattern.

The inclusion of two or more adjacent machine side CMD yarns between machine side knuckles can diminish considerably the twinning effect that has been present in prior art double-layer fabrics having zig-zagging machine side CMD yarns. The separation of these machine side knuckles tends to reduce the tension in the MD yarns in the sections thereof between the paper side knuckles. Accordingly, the paper side CMD yarns receive less twinning force from the MD yarns. As a result, drainage through the fabric 20 can be improved.

The form of the yarns utilized in the fabrics of the present invention can vary, depending upon the desired properties of the final papermakers' fabric. For example, the yarns may be multifilament yarns, monofilament yarns, twisted multifilament or monofilament yarns, spun yarns, or any combination thereof. Also, the materials comprising yarns employed in the fabric of the present invention may be those commonly used in papermakers' fabric. For example, the yarns may be formed of cotton, wool, polypropylene, polyester, aramid, polyamide, or the like. The skilled artisan should select a yarn material according to the particular application of the final fabric.

Preferably, the paper side CMD yarns are of a smaller diameter than the machine side CMD yarns, with the diameter of the MD yarns being between about 0.10–0.20 mm, and preferably between about 0.12 and 0.15 mm. The particular size of the MD and CMD yarns is typically governed by the size and spacing of the papermaking surface CMD yarns of the base fabric. Generally, the diameter of the paper side CMD yarns is about 50 to 75 percent of the diameter of the machine side CMD yarns, and the diameter of the MD yarns is between about 80 to 120 percent of the diameter of the paper side CMD yarns.

The foregoing embodiments are illustrative of the present invention, and are not to be construed as limiting thereof. The invention is defined by the following claims, with equivalents of the claims to be included therein.

That which is claimed is:

1. A papermakers' forming fabric, said fabric having a top machine side and opposing bottom paper side and comprising machine direction yarns and cross machine direction yarns interwoven in a repeating pattern of multiple repeating units, wherein a repeating unit of said pattern comprises:

a first preselected number of paper side cross-machine direction yarns forming said paper side of said fabric;

a second preselected number of machine side cross-machine direction yarns forming said machine side of said fabric, said first preselected number being at least twice as large as said second preselected number, and each of said machine side cross machine direction yarns being positioned below a paper side cross machine direction yarn;

a third preselected number of machine direction yarns, each of said machine direction yarns being interwoven with both said paper side cross machine direction yarns and said machine side cross machine direction yarns, said machine direction yarns comprising first and second sets of machine direction yarns, said first and second sets of machine direction yarns being arranged in an alternating pattern, with each machine direction yarn of said first set being positioned between two machine direction yarns of said second set, and each machine direction yarn of said second set being positioned between two machine direction yarns of said first set;

wherein, within said repeating unit, each of said machine direction yarns of said first set passes above four paper side cross machine direction yarns to form first, second, third and fourth paper side knuckles, said first and second paper side knuckles being separated from one another by at least two paper side cross machine direction yarns, and said third and fourth paper side knuckles being separated by at least two paper side cross machine direction yarns;

wherein each of said machine direction yarns of said second set passes above four paper side cross machine direction yarns to form fifth, sixth, seventh and eighth paper side knuckles, said fifth and sixth paper side knuckles being separated from one another by at least two paper side cross machine direction yarns, and said seventh and eighth paper side knuckles being separated by at least two paper side cross machine direction yarns;

each of said machine direction yarns of said first set passes below four machine side cross machine direction yarns to form first, second, third and fourth machine side knuckles, and each of said machine direction yarns of said second set passes below three machine side cross machine direction yarns to form fifth, sixth and seventh paper side knuckles;

and wherein each of said machine side first, second, third and fourth knuckles formed by one machine direction yarn of said first set passing under respective machine side cross machine direction yarns has a corresponding one of said first, second, third and fourth knuckles on an adjacent machine direction yarn of said first set formed under the same machine side cross machine direction yarn;

and wherein each of two of said fifth, sixth and seventh machine side knuckles formed by one machine direction yarn of said second set under respective machine side cross machine direction yarns has a corresponding one of said fifth, sixth and seventh knuckles on an adjacent machine direction yarn of said second set formed under the same machine side cross machine direction yarn, and wherein the other one of said fifth, sixth and seventh knuckles of said one machine direction yarn of said second set has no corresponding fifth, sixth or seventh knuckle on an adjacent machine direction yarn of said second set formed under the same machine side cross machine direction yarn.

2. The papermakers' forming fabric defined in claim 1, wherein each of said machine side cross machine direction yarns has a first diameter, each of said paper side cross machine direction yarns has a second diameter, and the ratio between said second and first diameters is between about 50 and 75 percent.

3. The papermakers' forming fabric defined in claim 2, wherein each of said machine direction yarns has a third diameter, and the ratio between said second and third diameters is between about 50 and 75 percent.

4. The papermakers' forming fabric defined in claim 1, wherein said first preselected number of paper side cross machine direction yarns is 32, and said second preselected number of machine side cross machine direction yarns is 16.

5. The papermakers' forming fabric defined in claim 4, wherein said third preselected number of machine direction yarns is 16.

6. The papermakers' forming fabric defined in claim 1, wherein each of said machine side cross machine direction yarns is substantially aligned with a respective paper side cross machine direction yarn.

7. The papermakers' forming fabric defined in claim 6, wherein alternate paper side cross machine direction yarns are substantially aligned with respective machine side cross machine direction yarns.

8. The papermakers' forming fabric defined in claim 1, wherein said first and second machine side knuckles are separated by one machine side cross machine direction yarn, and said third and fourth machine side knuckles are separated by one machine direction yarn.

9. The papermakers' forming fabric defined in claim 8, wherein said fifth and sixth machine side knuckles are separated by one machine side cross machine direction yarn.

10. The papermakers' forming fabric defined in claim 1, wherein each of said fifth, sixth, seventh and eighth paper side knuckles of each yarn of said second set of machine direction yarns are formed over paper side cross-machine direction yarns that are not positioned above a machine side cross-machine direction yarn under which adjacent machine direction yarns of said first set form machine side knuckles.

11. A papermakers' forming fabric, said fabric having a top machine side and an opposing bottom paper side and comprising machine direction yarns and cross machine direction yarns interwoven in a repeating pattern of multiple repeating units, wherein a repeating unit of said pattern comprises:

a first preselected number of paper side cross-machine direction yarns forming said paper side of said fabric;

a second preselected number of machine side cross-machine direction yarns forming said machine side of said fabric, said first preselected number being at least twice as large as said second preselected number, and each of said machine side cross machine direction yarns being positioned below a paper side cross machine direction yarn;

a third preselected number of machine direction yarns, each of said machine direction yarns being interwoven with both said paper side cross machine direction yarns and said machine side cross machine direction yarns;

wherein, within said repeating unit, each of said machine direction yarns passes above two paper side cross machine direction yarns to form first and second paper side knuckles, said first and second paper side knuckles being separated from one another by at least two paper side cross machine direction yarns;

wherein each of said machine direction yarns passes below two machine side cross machine direction yarns to form first and second machine side knuckles;

and wherein each of said machine side knuckles formed by a first machine direction yarn has a corresponding one of said first and second knuckles on a second machine direction yarn formed under the same machine side cross machine direction yarn, said first and second machine direction yarns being separated by a third machine direction yarn;

and wherein said first and second paper side knuckles of said third machine direction yarn are formed as said third machine direction yarn passes over paper side cross machine direction yarns other than said paper side cross machine direction yarn positioned directly above a machine side cross machine direction yarn under which said first machine side knuckle of said first machine direction yarn is formed.

12. The papermakers' forming fabric defined in claim 11, wherein each of said machine side cross machine direction yarns has a first diameter, each of said paper side cross machine direction yarns has a second diameter, and the ratio between said second and first diameters is between about 50 and 75 percent.

13. The papermakers' forming fabric defined in claim 12, wherein each of said machine direction yarns has a third diameter, and the ratio between said second and third diameters is between about 50 and 75 percent.

14. The papermakers' forming fabric defined in claim 11, wherein said first preselected number of paper side cross machine direction yarns is 32, and said second preselected number of machine side cross machine direction yarns is 16.

15. The papermakers' forming fabric defined in claim 14, wherein said third preselected number of machine direction yarns is 16.

16. The papermakers' forming fabric defined in claim 11, wherein each of said machine side cross machine direction yarns is substantially aligned with a respective paper side cross machine direction yarn.

17. The papermakers' forming fabric defined in claim 16, wherein alternate paper side cross machine direction yarns are substantially aligned with respective machine side cross machine direction yarns.

18. The papermakers' forming fabric defined in claim 11, wherein said first and second paper side knuckles are separated by two adjacent paper side cross machine direction yarns.

19. A method of making paper, comprising the steps of:

(a) providing a papermakers' forming fabric, said fabric having a top machine side and an opposing bottom paper side and comprising machine direction yarns and cross machine direction yarns interwoven in a repeating pattern of multiple repeating units, wherein a repeating unit of said pattern comprises:

a first preselected number of paper side cross-machine direction yarns forming said paper side of said fabric;

a second preselected number of machine side cross-machine direction yarns forming said machine side of said fabric, said first preselected number being at least twice as large as said second preselected number, and each of said machine side cross machine direction yarns being positioned below a paper side cross machine direction yarn;

a third preselected number of machine direction yarns, each of said machine direction yarns being interwoven with both said paper side cross machine direction yarns and said machine side cross machine direction yarns, said machine direction yarns comprising first and second sets of machine direction yarns, said first and second sets of machine direction yarns being arranged in an alternating pattern, with each machine direction yarn of said first set being positioned between two machine direction yarns of said second set, and each machine direction yarn of said second set being positioned between two machine direction yarns of said first set;

wherein, within said repeating unit, each of said machine direction yarns of said first set passes above four paper side cross machine direction yarns to form first, second, third and fourth paper side knuckles, said first and second paper side knuckles being separated from one another by at least two paper side cross machine direction yarns, and said third and fourth paper side knuckles being separated by at least two paper side cross machine direction yarns;

wherein each of said machine direction yarns of said second set passes above four paper side cross machine direction yarns to form fifth, sixth, seventh and eighth paper side knuckles, said fifth and sixth paper side knuckles being separated from one another by at least two paper side cross machine direction yarns, and said seventh and eighth paper side knuckles being separated by at least two paper side cross machine direction yarns;

each of said machine direction yarns of said first set passes below four machine side cross machine direction yarns to form first, second, third and fourth machine side knuckles, and each of said machine direction yarns of said second set passes below three machine side cross machine direction yarns to form fifth, sixth and seventh paper side knuckles;

and wherein each of said machine side first, second, third and fourth knuckles formed by one machine direction yarn of said first set under respective machine side cross machine direction yarns has a corresponding one of said first, second, third and fourth knuckles on an adjacent machine direction yarn of said first set formed under the same machine side cross machine direction yarn;

and wherein each of two of said fifth, sixth and seventh machine side knuckles formed by one machine direction yarn of said second set under respective machine side cross machine direction yarns has a corresponding one of said fifth, sixth and seventh knuckles on an adjacent machine direction yarn of said second set formed under the same machine side cross direction yarn, and wherein the other one of said fifth, sixth and seventh knuckles of said one machine direction yarn of said second set has no corresponding fifth, sixth or seventh knuckle on an adjacent machine direction yarn of said second set formed under the same machine side cross machine direction yarn;

depositing paper stock on said fabric; and removing moisture from said paper stock.

20. The method defined in claim 19, wherein in said providing step, each of said machine side cross machine direction yarns of said fabric has a first diameter, each of said paper side cross machine direction yarns has a second diameter, and the ratio between said first and second diameters is between about 50 and 75 percent.

21. The method defined in claim 20, wherein in said providing step, each of said machine direction yarns of said fabric has a third diameter, and the ratio between said second and third diameters is between about 50 and 75 percent.

22. The method defined in claim 19, wherein in said providing step, said first preselected number of paper side crossmachine direction yarns of said fabric is 32, and said second preselected number of machine side cross machine direction yarns of said fabric is 16.

23. The method defined in claim 22, wherein in said providing step, said third preselected number of machine direction yarns of said fabric is 16.

24. The method defined in claim 19, wherein in said providing step, each of said machine side cross machine direction yarns of said fabric is substantially aligned with a respective paper side cross machine direction yarn.

25. The method defined in claim 24, wherein in said providing step, alternate paper side cross machine direction yarns are substantially aligned with respective machine side cross machine direction yarns.

26. The method defined in claim 19, wherein in said providing step, said first and second machine side knuckles are separated by one machine side cross machine direction yarn, and said third and fourth machine side knuckles are separated by one machine direction yarn.

27. The method defined in claim 19, wherein in said providing step, said fifth and sixth machine side knuckles are separated by one machine side cross machine direction yarn.

28. The method defined in claim 19, wherein in said providing step, each of said fifth, sixth and seventh knuckles of each yarn of said second set of machine direction yarns are formed over paper side cross-machine direction yarns that are not positioned above a machine side cross-machine direction yarn under which adjacent machine direction yarns of said first set form machine side knuckles.

* * * * *